US007445011B2

(12) United States Patent
Fleischhauer et al.

(10) Patent No.: US 7,445,011 B2
(45) Date of Patent: Nov. 4, 2008

(54) METHOD FOR IMPROVING THE LOADING CAPACITY OF TOBACCO

(75) Inventors: Holger Fleischhauer, Hamburg (DE); Jürgen Klischat, Pinneberg (DE); Thomas Pienemann, Rosengarten (DE); Peter Skupin, Berlin (DE); Claus-Dieter Ziehn, Pinneberg (DE)

(73) Assignee: Reemtsma Cigarettenfabriken GmbH

( * ) Notice: Subject to any disclaimer, the term of this patent is extended or adjusted under 35 U.S.C. 154(b) by 152 days.

(21) Appl. No.: 10/520,024

(22) PCT Filed: Jun. 10, 2003

(86) PCT No.: PCT/EP03/06940

§ 371 (c)(1),
(2), (4) Date: Aug. 24, 2005

(87) PCT Pub. No.: WO2004/002245

PCT Pub. Date: Jan. 8, 2004

(65) Prior Publication Data

US 2006/0090767 A1 May 4, 2006

(30) Foreign Application Priority Data

Jul. 1, 2002 (DE) ..... 102 29 451

(51) Int. Cl.
*A24B 3/18* (2006.01)

(52) U.S. Cl. ..... 131/291; 131/290; 131/296; 131/293

(58) Field of Classification Search ..... 131/290, 131/291, 296
See application file for complete search history.

(56) References Cited

U.S. PATENT DOCUMENTS

| | | | | |
|---|---|---|---|---|
| 3,753,440 | A * | 8/1973 | Ashburn | 131/296 |
| 4,289,148 | A * | 9/1981 | Ziehn | 131/291 |
| 4,577,646 | A * | 3/1986 | Ziehn | 131/296 |
| 5,649,552 | A | 7/1997 | Cho et al. | |

FOREIGN PATENT DOCUMENTS

| | | |
|---|---|---|
| DE | 2903300 | 7/1980 |
| DE | 10006424 | 8/2001 |
| DE | 10006425 | 8/2001 |
| WO | WO0221947 | 3/2002 |

* cited by examiner

*Primary Examiner*—Philip C Tucker
*Assistant Examiner*—Phu H Nguyen
(74) *Attorney, Agent, or Firm*—Hovey Williams LLP

(57) ABSTRACT

The invention relates to a process for enhancing the filling capacity of tobacco, such as cut tobacco leaf or tobacco midribs, or tobacco additional material, by treating the tobacco material having an initial moisture of 10-30% with a treatment gas consisting of nitrogen and/or argon at pressures of 400 to 1,000 bar followed by a continuous decompression and subsequent thermal post-treatment of the discharged tobacco material. The filling density of the tobacco charge in the autoclave is greater than 0.2 kg/dm$^3$.

12 Claims, No Drawings

METHOD FOR IMPROVING THE LOADING CAPACITY OF TOBACCO

BACKGROUND OF INVENTION

1. Field of Invention

The invention relates to a process for enhancing the filling capacity of pressed tobacco, such as cut tobacco leaf or tobacco midribs, or of tobacco additional material, by treating the tobacco material with a treatment gas consisting of nitrogen and/or argon at pressures of 400 to 1,000 bar followed by a continuous decompression and subsequent thermal post-treatment of the discharged tobacco material.

2. Discussion of Prior Art

Processes of this type, which are also known as INCOM expansion processes, have to be advantageous compared with the pressure treatment of tobacco using carbon dioxide, ammonia or volatile organic gases. Thus DE 29 03 300 C2 describes such an expansion process using working pressures between 300 and 800 bar. The examples show a large effect of the final pressure on the filling capacity enhancement, but only an insignificant effect of the exposure time in the range between 1 and 10 minutes. The publication contains no reference to possible compression or compaction of the tobacco.

DE 31 19 330 C2 discloses the thermal treatment of the pressurized-gas-treated tobacco by water vapour or saturated steam and refers with respect to the high-pressure treatment to the already mentioned patent DE 29 03 300 C2.

Further, DE 34 14 625 C2 describes a cascade process, according to which, via highly varied measures such as cooling the treatment gas before charging the reactor, cooling the autoclave, or using a subcooled and liquefied treatment gas, it is to be ensured that the temperature of the discharged tobacco is below 0° C. before the heat treatment. The examples are based on filling the 200 l autoclave with 30 kg of tobacco, which corresponds to a filling density of 0.15 kg/dm$^3$.

The patent DE 39 35 774 C2 describes the cooling of the compressed treatment gas in the autoclave via an external heat exchanger, in which case a plurality of autoclaves were connected together to form what is termed a train. The process ultimately represents a special type of cooling the gas and goods to be treated.

DE 100 06 425 C1 describes treating a tobacco of relatively low moisture up to about 16% at a working temperature above 55° C. From the autoclave volume of 2 dm$^3$ used, and an initial tobacco weight of 300 g, a filling density of the tobacco charge of 0.15 kg/dm$^3$ is calculated, which corresponds to the already cited DE 34 14 625 C2.

DE 100 06 424 A1 discloses the decompression having at least one holding stage and heating the system under a residual pressure to achieve tobacco discharge temperatures of 10 to 80° C.

The filling densities of approximately 0.15 kg/dm$^3$ described in the prior art are obtained when the tobacco is charged into the pressure vessel without a further pressing operation. Increasing the filling density, in the known processes using rapid pressure buildup, produced, in contrast, lower filling capacities of the expanded tobacco material.

SUMMARY OF THE INVENTION

It is an object of the present invention to develop the known processes further so that they are more economical than hitherto with comparably high filling capacity.

Surprisingly, it has been found in fact that, contrary to the teaching from DE 29 03 300 C2, in the range of high filling densities, the time of action of the compressed gas does exert a considerable effect on the resulting filling capacity of the expanded tobacco material.

The cited prior art describes how the underlying process can be further optimized with regard to as high a filling capacity as possible of the expanded tobacco material. However, in addition to the increase in filling capacity, the tobacco charge for a given autoclave volume is an important factor for the economic efficiency of the INCOM process. An increase in the filling charge not only makes a higher throughput possible, but in addition leads to a decrease in the specific consumption of treatment gas and compression energy for a given amount of tobacco to be expanded.

DETAILED DESCRIPTION OF THE PREFERRED EMBODIMENT

The inventive process is described in more detail below with reference to examples.

For this, first the term "pressure time" will be defined as the total of the pressure-buildup time up to the time the final pressure is first reached, and the optimum holding time after reaching the final pressure up to the start of the decompression operation.

An inventive sufficiently long pressure time can be achieved by the following variants of the process procedure:

i. slow pressure buildup until the directly following decompression
ii. rapid pressure buildup with subsequent holding time, that is to say allowing the vessel to stand under pressure without feed or removal of treatment gas
iii. rapid pressure buildup with subsequent holding time, before start of decompression there is a further feed of treatment gas to again reach the final pressure.

Since the pressure in the vessel decreases during the holding time owing to cooling, a process procedure as under variant iii., makes it possible to re-establish the final pressure before the decompression. Surprisingly, this procedure, compared with variant ii., leads to a further, although small, increase in filling capacity.

The following examples 1 and 2 describe first the effect of various pressure times and process variants at a filling density of tobacco in the pressure vessel of 0.15 kg/dm$^3$ according to the prior art:

EXAMPLE 1

The high-pressure treatment was carried out in a laboratory autoclave using a contents volume of 2 dm$^3$. Jacketing for circulating liquid media served for setting the desired working temperatures. The pressure buildup proceeded from below, and the pressure reduction from above. A plurality of valves made the intended connection diagrams possible. A compressor served for setting the final pressure.

The laboratory apparatus for thermal post-treatment consisted of a permeable wire mesh serving as conveyor belt, guide plates for forming the tobacco web in the desired width, a steam nozzle having a slotted exit orifice and a steam extractor disposed beneath the belt. The post-treatment with saturated steam was performed at a belt velocity of 5 cm/s and a steam output of 10 kg/h.

The tobacco samples were spread out in flat plastic dishes and conditioned under standardized climatic conditions at 21° C. and 62% relative humidity. The filling capacities were determined using a Borgwaldt densimeter, and the specific volume, in cm$^3$/g, was converted to a nominal moisture of 12% by weight and a nominal temperature of 22° C. From the data of the untreated control or base samples and the expanded samples, the relative filling capacity increase, also termed degree of expansion, is calculated from the following formula, where $F_B$ is the filling capacity of the base sample and $F_E$ is the filling capacity of the expanded tobacco:

$$\Delta\%=(F_E-F_B)*100\%/F_B$$

The experiments were carried out at a tobacco moisture of 18% by weight and initial tobacco weights of 300 g. The working temperature was set by thermostating to 40° C. The final pressure was 700 bar, and the decompression was performed in the course of about 0.5 min. All experiments were based on a uniform mixture of Virginia tobaccos and the described post-treatment method using saturated steam. Variations were made in the pressure buildup time, the holding time after reaching the final pressure, and also the option of further feed at the end of the holding time. Table 1 contains a compilation of the experimental parameters and the relative increases in filling capacity, or degrees of expansion, achieved.

TABLE 1

Relative increase in filling capacity (filling density 0.15 kg/l, working temperature 40° C., tobacco moisture 18%)

| Process variant | i. | i. | i. | ii. | ii. | iii. | iii. |
|---|---|---|---|---|---|---|---|
| Pressure buildup time (min) | 3 | 6 | 12 | 3 | 3 | 3 | 3 |
| Holding time (min) | 0 | 0 | 0 | 5 | 10 | 5 | 10 |
| Pressure time (min) | 3 | 6 | 12 | 8 | 13 | 8 | 13 |
| Increase in filling capacity Δ% | 67 | 68 | 72 | 68 | 68 | 70 | 71 |

EXAMPLE 2

The experiments were carried out in a similar manner to Example 1, but at a tobacco moisture of 12% and a working temperature of 60° C. Table 2 contains the experimental parameters and also the relative increases in filling capacity or degrees of expansion achieved.

TABLE 2

Relative increase in filling capacity (filling density 0.15 kg/dm$^3$, working temperature 60° C., tobacco moisture 12%)

| Process variant | i. | i. | ii. | iii. |
|---|---|---|---|---|
| Pressure buildup time (min) | 3 | 30 | 3 | 3 |
| Holding time (min) | 0 | 0 | 5 | 5 |
| Pressure time (min) | 3 | 30 | 8 | 8 |
| Increase in filling capacity Δ% | 77 | 79 | 75 | 76 |

The results of Examples 1 and 2 clearly show that in the range of conventional filling densities, the pressure time has only a small effect on the increase in filling capacity.

The following Examples 3 and 4 show the effect of different pressure times and process variants at a tobacco filling density in accordance with the invention in the pressure vessel of greater than 0.2 kg/dm$^3$:

EXAMPLE 3

The experiments were carried out in a similar manner to Example 1, but using an initial tobacco weight of 500 g. The tobacco was compressed by manual pressing during filling of the pressure vessel. Table 3 contains the compilation of the experimental parameters and the relative increases in filling capacity, or degrees of expansion, achieved.

TABLE 3

Relative increase in filling capacity (filling density 0.25 kg/dm$^3$, working temperature 40° C., tobacco moisture 18%)

| Process variant | i. | i. | i. | ii. | ii. | iii. | iii. |
|---|---|---|---|---|---|---|---|
| Pressure buildup time (min) | 3 | 12 | 20 | 3 | 3 | 3 | 3 |
| Holding time (min) | 0 | 0 | 0 | 5 | 10 | 5 | 10 |
| Pressure time (min) | 3 | 12 | 20 | 8 | 13 | 8 | 13 |
| Increase in filling capacity Δ% | 55 | 65 | 71 | 67 | 68 | 69 | 69 |

EXAMPLE 4

The experiments were carried out in a similar manner to Example 2, but using an initial tobacco weight of 450 g. The tobacco was heated to approximately 50° C. using a microwave oven before the pressure vessel was filled and was compressed by manual pressing during filling. Table 4 contains the compilation of the experimental parameters and the relative increases in filling capacity or degrees of expansion achieved.

TABLE 4

Relative increase in filling capacity (filling density 0.225 kg/dm$^3$, working temperature 60° C., tobacco moisture 12%)

| Process variant | i. | i. | ii. | iii. |
|---|---|---|---|---|
| Pressure buildup time (min) | 3 | 20 | 3 | 3 |
| Holding time (min) | 0 | 0 | 10 | 5 |
| Pressure time (min) | 3 | 20 | 13 | 8 |
| Increase in filling capacity Δ% | 65 | 76 | 73 | 74 |

Examples 3 and 4 illustrate the effect of pressure time on the increase in filling capacity at inventive filling densities greater than 0.2 kg/dm$^3$. A good expansion effect can only be achieved under these conditions if the pressure time exceeds a value of approximately 300 sec. Furthermore, it is clear that at comparable pressure times, process variant iii. gives the best results.

Another embodiment of the present invention concerns a process for enhancing the filling capacity of tobacco material or tobacco additional material, wherein the material is mechanically compressed before, during or after the pressure vessel is filled.

The invention claimed is:

1. A process for enhancing the filling capacity of tobacco material or tobacco additional material, wherein the material has an initial moisture of 10-30%, said process comprising the steps of:

treating the material within a pressure vessel with a treatment gas selected from the group consisting of nitrogen, argon, and mixtures thereof at pressures of 400 to 1,000 bar followed by a continuous decompression; and subsequently thermally post-treating the discharged material, wherein during the process the filling density of the material in the pressure vessel is greater than 0.2 kg/dm$^3$, said step of treating the material presents a pressure time defined between the start of pressure buildup and decompression, said pressure time being at least 300 sec.

2. The process according to claim 1, wherein the material is mechanically compressed before, during or after the pressure vessel is filled.

3. The process according to claim 2, wherein the material is heated before or during compression.

4. The process according to claim 3, wherein the pressure vessel is rapidly pressurized such that at least some of the pressure time of at least 300 sec involves allowing the vessel to stand under pressure.

5. The process according to claim 4, wherein after the vessel is allowed to stand, before the decompression, renewed pressurization is performed.

6. The process according to claim 3, wherein renewed pressurization is performed before the decompression.

7. The process according to claim 2, wherein the pressure vessel is rapidly pressurized such that at least some of the pressure time of at least 300 sec involves allowing the vessel to stand under pressure.

8. The process according to claim 7, wherein after the vessel is allowed to stand, before the decompression, renewed pressurization is performed.

9. The process according to claim 2, wherein renewed pressurization is performed before the decompression.

10. The process according to claim 1, wherein the pressure vessel is rapidly pressurized such that at least some of the pressure time of at least 300 sec involves allowing the vessel to stand under pressure.

11. The process according to claim 10, wherein after the vessel is allowed to stand, before the decompression, renewed pressurization is performed.

12. The process according to claim 1, wherein renewed pressurization is performed before the decompression.

* * * * *